US005891523A

United States Patent [19]

Feldstein

[11] Patent Number: 5,891,523

[45] Date of Patent: Apr. 6, 1999

[54] METHOD FOR MANUFACTURING METALLIZED HEAT TREATED PRECISION ARTICLES

[75] Inventor: Nathan Feldstein, Princeton, N.J.

[73] Assignee: Surface Technology, Inc., Trenton, N.J.

[21] Appl. No.: 102,674

[22] Filed: Aug. 9, 1993

Related U.S. Application Data

[63] Continuation of Ser. No. 828,621, Jan. 31, 1992, abandoned.

[51] Int. Cl.[6] ..... B05D 3/02

[52] U.S. Cl. ..... 427/318; 427/319; 427/320; 427/321; 427/328; 427/380; 427/353.7

[58] Field of Search ..... 427/319, 328, 427/320, 321, 380, 383.7

[56] References Cited

U.S. PATENT DOCUMENTS

| | | | |
|---|---|---|---|
| 2,937,413 | 5/1960 | Hollingsworth | 19/114 |
| 3,295,198 | 1/1967 | Coan | 427/328 |
| 3,833,968 | 9/1974 | Arai et al. | 19/114 |
| 3,936,577 | 2/1976 | Christini et al. | 427/438 |
| 4,169,019 | 9/1979 | Motobayashi et al. | 204/15 |
| 4,172,155 | 10/1979 | Pease | 427/319 |
| 4,358,923 | 11/1982 | Feldstein | 427/367 |
| 4,547,407 | 10/1985 | Spencer, Jr. | 427/387 |
| 4,859,494 | 8/1989 | Lancsek | 427/47 |
| 4,859,994 | 8/1989 | Zola et al. | 340/705 |
| 5,006,367 | 4/1991 | Lancsek | 427/129 |

*Primary Examiner*—Benjamin Utech
*Attorney, Agent, or Firm*—Lerner, David, Littenberg, Krumholz & Mentlik

[57] ABSTRACT

The invention provides a method for the metallizing of precision machine parts coupled with heat-treatment and machining to insure the minimal handling the remachining generally required due to dimensional distortion resulting from the standard heat-treatment used in hardening the metallized coating.

3 Claims, 1 Drawing Sheet

FIG. 1
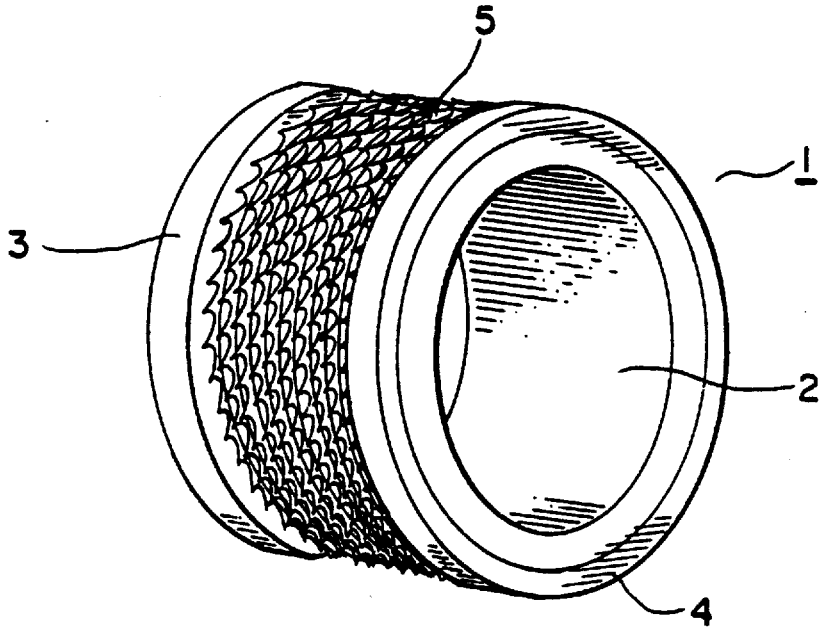
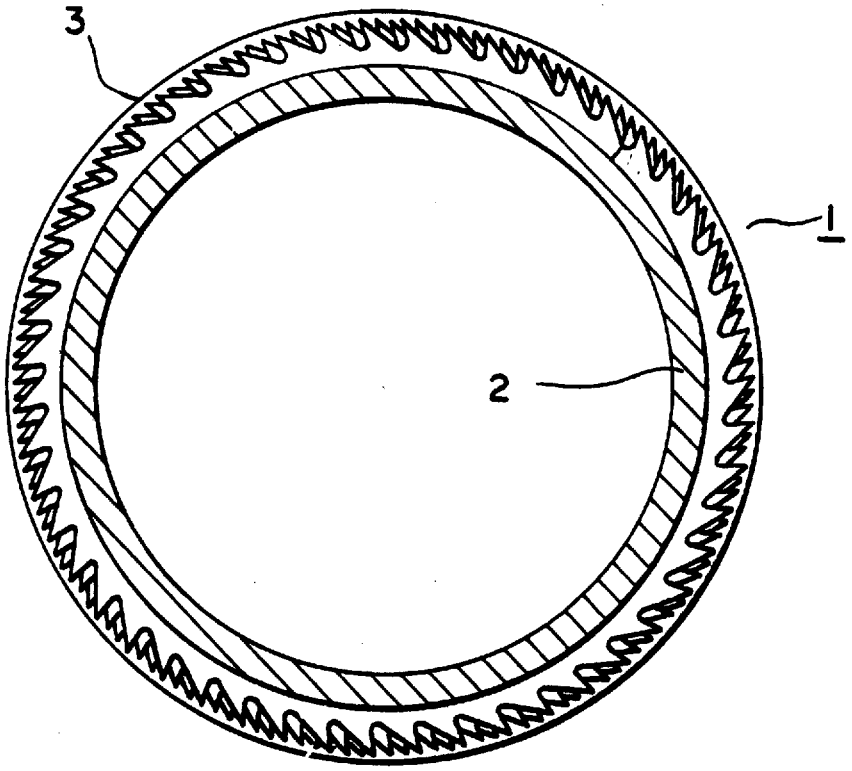
FIG. 2

METHOD FOR MANUFACTURING METALLIZED HEAT TREATED PRECISION ARTICLES

This is a continuation, of application Ser. No. 07/828,621 filed Jan. 31, 1992, now abandoned.

SUMMARY OF THE INVENTION

The present invention relates to a method wherein a precision machine part which has a coating applied thereto subsequent to machining and requires heat treatment subsequent to application of the coating is subjected to a preliminary heat treatment prior to application of the coating at a temperature or quantity of heat so as to substantially prevent distortion or shrinkage of the part upon final heat treatment applied subsequent to the application of the coating.

It has been found that adding a suitable preliminary heat treatment step obviates the need to significantly re-machine the parts subsequent to application of the coating and heat treatment thereon. Depending upon the nature of the part and the sequence of the steps employed, the preliminary heat treatment can eliminate the need for a second major machining, e.g., honing, of the precision part or, in some instances as will hereinafter be set forth, improve the logistics involved with respect to the handling and marketing of such precision parts as well as distinguishing defective parts.

It may be noted that this invention has particular application in the manufacture of parts for the textile industry such as textile combing rolls.

BRIEF DESCRIPTION OF THE DRAWINGS

FIG. 1 is an isometric view of a textile combing roll.

FIG. 2 is the front view of FIG. 1.

DETAILED DESCRIPTION OF THE INVENTION

The present invention will be described with reference to the manufacture of textile combing rolls. However, it will be understood by those skilled in the art that the present invention will be useful in the manufacture of any coated precision machined article wherein processing requires a step or steps subsequent to machining and coating which step or steps include a heat treatment which normally tends to deform and/or shrink the part, thereby resulting in the need for further machining subsequent to such step or steps. It is understood that the coating is generally deposited onto the part to alter its surface properties.

An example of the present invention is shown herein with relation to the manufacture of a textile combing roll. Referring to FIG. 1, there is shown a typical combing roll (1) having a hollow cylindrical body (2). Typically, the hollow cylindrical body is made from aluminum or an aluminum alloy. Around the outer periphery of the combing roll (1) within the region between the ends is a plurality of spaced saw-toothed wires (3). The wires (3) are generally made from a ferromagnetic material, e.g., steel, and are provided with an electroless metal composite coating or other wear-resistant coating thereon, which coating may also be present on the body (2) of the roll (1). The dimensions of the roll must be precisely machined in order to fit correctly on a spindle of a textile combing apparatus. Typically, these parts are machined to tolerances of less than 1 mil. In the manufacture of the combing roll (1) after assembly and final machining, the combing roll is then coated with a composite metallic coating and heat treated subsequent to coating. As a result of the post-coating heat treatment, prior art combing rolls were found to be distorted and/or shrink, thereby requiring substantial re-machining of the combing roll. This presents a logistics problem with respect to these combing rolls due to the fact that most of the combing rolls used throughout the world are assembled and machined in a limited number of locations and then shipped both to the United States as well as other locations world-wide for coating and post-coating heat treatment. These coated rolls are then sent to intermediary sales organizations and/or the original source or directly to end users which, because of the distortion or shrinkage, must then have them re-machined before the level of tolerance is suitable for use.

I have now discovered that by subjecting the combing rolls to a preliminary heat treatment, e.g., after initial machining but prior to coating, at a temperature level near or above the temperature level of the final heat treatment given subsequent to coating, or otherwise providing sufficient heat, the final heat treatment does not cause any substantial further distortion. In this manner, the uncoated roll which is manufactured and machined at a limited number of installations can then be remachined prior to shipment for coating and application of a final heat treatment, thereby eliminating the need for any substantial remachining after the coating and its final heat treatment after the coating and its final heat treatment as well as eliminating the logistics problem relating to the marketing and sales of these parts. Further, it is believed that by pre-heat treating the assembled or unassembled parts prior to precision machining, one will not only substantially eliminate the distortion which ordinarily results in the final heat treatment subsequent to coating, but one can also eliminate or substantially reduce the need for a critical final re-machining step.

PARAMETERS FOR PREHEATING CONDITIONS

It is also anticipated that the present invention of preheat treatment will provide early revelation of defects within the machinery parts, such as metal fatigue or weak assembly of the product (i.e., wire crimping and/or surface cracking), which otherwise might not be noticeable until later stages of the total processing of the parts, thereby causing extra waste of resources.

Electroless plating and composite electroless plating are well documented. A recent text *Electroless Plating Fundamentals and Theory*, G. Mallory and J. Hdju editors, sponsored and published by the American Electroplaters and Surface Finishers Society, 1990, describes the state of the art and its evolution.

The following are some additional references demonstrating the coating aspect of certain precision machinery parts, and they are included herein by reference:

| | |
|---|---|
| Christini et al | Reissue 29,285 |
| Arai et al | U.S. Pat. No. 3,833,968 |
| J.D. Holingsworth | U.S. Pat. No. 2,937,413 |
| Spencer | U.S. Pat. No. 4,547,407 |
| Feldstein | U.S. Pat. No. 4,358,923 |
| Motobayashi et al | U.S. Pat. No. 4,169,019 |
| Lancsek | U.S. Pat. No. 4,859,494 |

Though these references recognize many subtleties associated with the fabrication of the machinery parts and the need for coatings, none has recognized nor proposed a solution to the current problem of distortion after final heat treatment.

The following are specific examples setting forth processing in accordance with the present invention as well as processing in accordance with the prior art. The Table set forth below summarizes the comparative results of the effect of the post-coating heat treatment on both pre-heat treated (Ex. 3) and non pre-heat treated (Ex. 1 and 2) rolls. As can be seen from the results, dimensional stability is maintained within the required tolerances only in the rolls which were pre-heat treated in accordance with the present invention. The rolls which were not pre-heat treated (prior art method) were distorted beyond allowable tolerances and required precision re-machining subsequent to coating.

It may also be noted that if the body of the rolls are cast or extruded, as opposed to initially machined, it is contemplated that the pre-heat treatment can be utilized prior to any machining as well as prior to coating.

EXAMPLE 1

A combing roll with internal dimensions of 2.185", 2.183" and 2.185" was plated with a composite electroless nickel deposit containing finely divided particulate diamond. After a final heat treatment at 290° C. for a cycle of 3.5 hours from initial start up, the internal dimensions were 2.1841", 2.182" and 2.184" respectively. The internal measurements were taken at the two extreme edges and at the center.

These final measurements correspond to the same locations within the combing roll on which the initial measurements were based. The accuracy of measurement is ±0.0005". Hence, significant change(s) of the internal dimensions were noted when comparing the initial measurements to the post-heat treatment measurements. A repeat of the same procedure applied to several other rolls reconfirm this trend.

EXAMPLE 2

A combing roll, similar to that used in Example 1, having internal dimensions of 2.182", 2.183" and 2.183" was plated as; above in Example 1. After plating and a first heat treatment as set forth in above, the final dimensions were observed to be 2.179", 2.180" and 2.179" respectively, once again demonstrating the vulnerability of the roll to changes with heat treatment. However, further heat treatment then resulted in final dimensions of 2.179", 2.180" and 2.179". Thus, the first heat treatment appears to provide a stabilization in dimensions.

EXAMPLE 3

In demonstrating the concept of the present invention, five rolls were pre-heat treated for about 8 hours at 300° C. The rolls were then machined to provide a uniform internal dimension of 2.185". Accuracy of the measurements was ±0.0005". These rolls were then plated per Example 1 and heat treated in the same fashion as in Example 1. Final dimensions were the same as the starting point, i.e., 2.185" with an accuracy of measurement of ±0.0005".

These results demonstrate the novelty of the present invention, that by providing the combination of a preliminary heat treatment with subsequent machining prior to coating, one can preserve the dimensions of a precision coated product which is then provided with a final heat treatment. Though in the present invention a composite electroless coating bearing diamond particles was used, other coatings (e.g., electroless plating or electroplating both with, or without, particles) bearing other particles may be used, all of which require a heat treatment to increase the wear life for the coating. Thus, the substitution of coatings which require the step of heat-treatment during deposition or thereafter falls within the spirit of the current invention. However, it should be noted that in some instances minor machining may be desirable after the final coating and heat-treatment, which machining however is optional.

What is claimed is:

1. A method of manufacturing a coated precision metal part, said method comprising preliminarily heat treating a metal part at a first temperature cycle sufficient to effect dimensional distortion thereof, conforming the preliminarily heat treated metal part to a dimension, forming a metal coating on a least a portion of the conformed metal part, and secondarily heat treating the coated conformed metal part at a second temperature cycle insufficient to effect significant dimensional distortion thereof, whereby the secondarily heat treated metal part conforms to said dimension.

2. The method according to claim 1 wherein said precision metal part is a combing roll.

3. The method according to claim 1 wherein said metal coating comprises an electroless composite coating.

* * * * *